US011117187B2

(12) United States Patent
Harada et al.

(10) Patent No.: US 11,117,187 B2
(45) Date of Patent: Sep. 14, 2021

(54) CASTING NOZZLE

(71) Applicant: KROSAKIHARIMA CORPORATION, Fukuoka (JP)

(72) Inventors: Takafumi Harada, Fukuoka (JP); Kouichi Tachikawa, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 0 days.

(21) Appl. No.: 16/624,470

(22) PCT Filed: Jun. 19, 2018

(86) PCT No.: PCT/JP2018/023235
§ 371 (c)(1),
(2) Date: Dec. 19, 2019

(87) PCT Pub. No.: WO2018/235801
PCT Pub. Date: Dec. 27, 2018

(65) Prior Publication Data

US 2020/0108440 A1 Apr. 9, 2020

(30) Foreign Application Priority Data

Jun. 20, 2017 (JP) ..... JP2017-120713
Mar. 1, 2018 (JP) ..... JP2018-036756

(51) Int. Cl.
*B22D 41/58* (2006.01)
*B22D 11/10* (2006.01)

(52) U.S. Cl.
CPC ..... *B22D 41/58* (2013.01); *B22D 11/10* (2013.01)

(58) Field of Classification Search
CPC ..... B22D 11/10; B22D 41/50; B22D 41/58
See application file for complete search history.

(56) References Cited

U.S. PATENT DOCUMENTS 4,360,190 A * 11/1982 Ato ..... B22D 41/58 222/603
4,854,487 A * 8/1989 Ando ..... B22D 41/502 222/606
2017/0014897 A1 1/2017 Krosakiharima

FOREIGN PATENT DOCUMENTS

JP 62-130753 A 6/1987
JP 05-023808 A 2/1993
JP 2006-175482 A 7/2006
JP 2011-212721 A 10/2011
(Continued)

OTHER PUBLICATIONS

International Search Report dated Aug. 9, 2018 for PCT/JP2018/023235 filed Jun. 19, 2018.
(Continued)

*Primary Examiner* — Kevin E Yoon
(74) *Attorney, Agent, or Firm* — Paul D. Bianco; Gary S. Winer; Fleit Intellectual Property Law

(57) ABSTRACT

Disclosed is a casting nozzle intended to suppress or prevent breaking of a nozzle body thereof. The casting nozzle comprises: a nozzle body; a metal casing disposed to surround an upper end of the nozzle body to form a gas pool between an outer peripheral surface of the upper end of the nozzle body and an inner peripheral surface of the metal casing; and a bridging segment provided in at least a part of the gas pool to bridge between the outer peripheral surface of the upper end of the nozzle body and the inner peripheral surface of the metal casing.

8 Claims, 7 Drawing Sheets

(56) References Cited

FOREIGN PATENT DOCUMENTS

| | | |
|---|---|---|
| JP | 2014-133241 A | 7/2014 |
| JP | 2015-157316 A | 9/2015 |

OTHER PUBLICATIONS

Written Opinion for PCT/JP2018/023235 filed Jun. 19, 2018.
International Preliminary Report on Patentability dated Dec. 31, 2019 with Written Opinion, for PCT/JP2018/023235 filed Jun. 19, 2018 (English translation).

* cited by examiner

Fig. 1
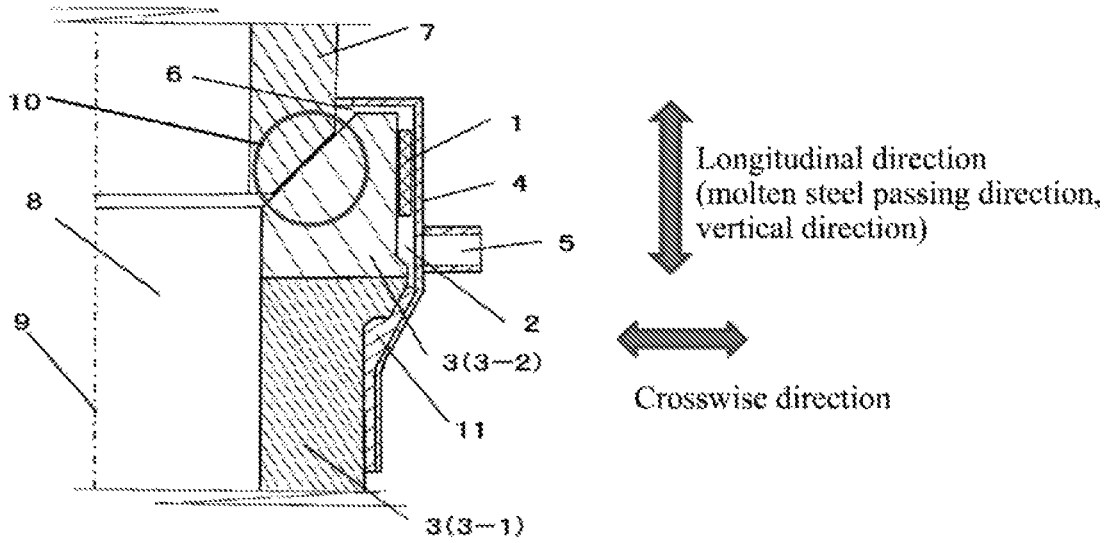
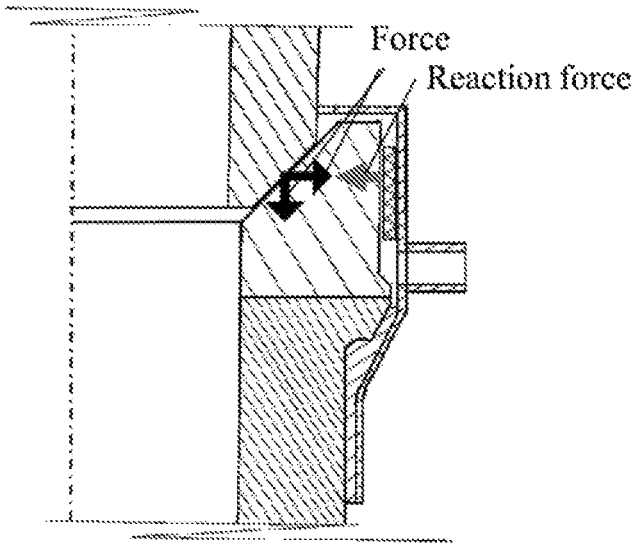
Fig. 2

Fig. 3
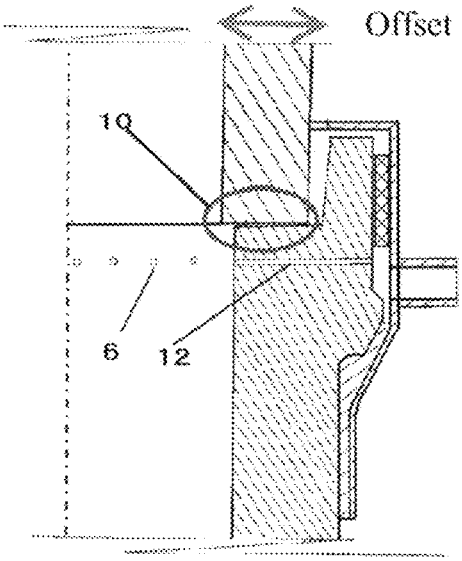
Fig. 4
(PRIOR ART)
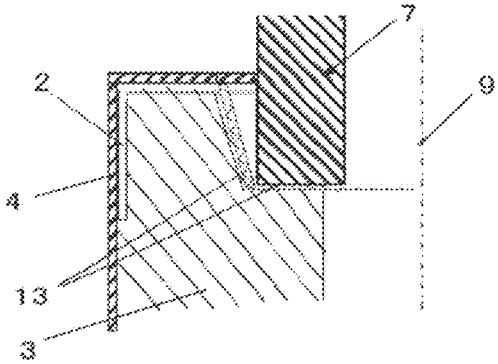
Fig. 5
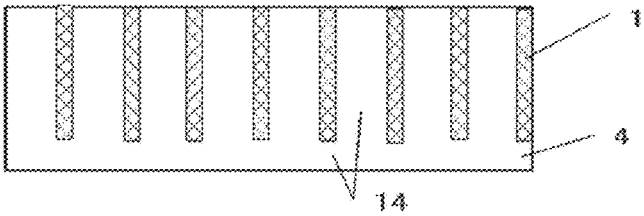
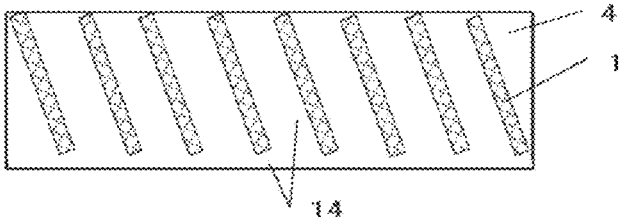
Fig. 6

Fig. 12
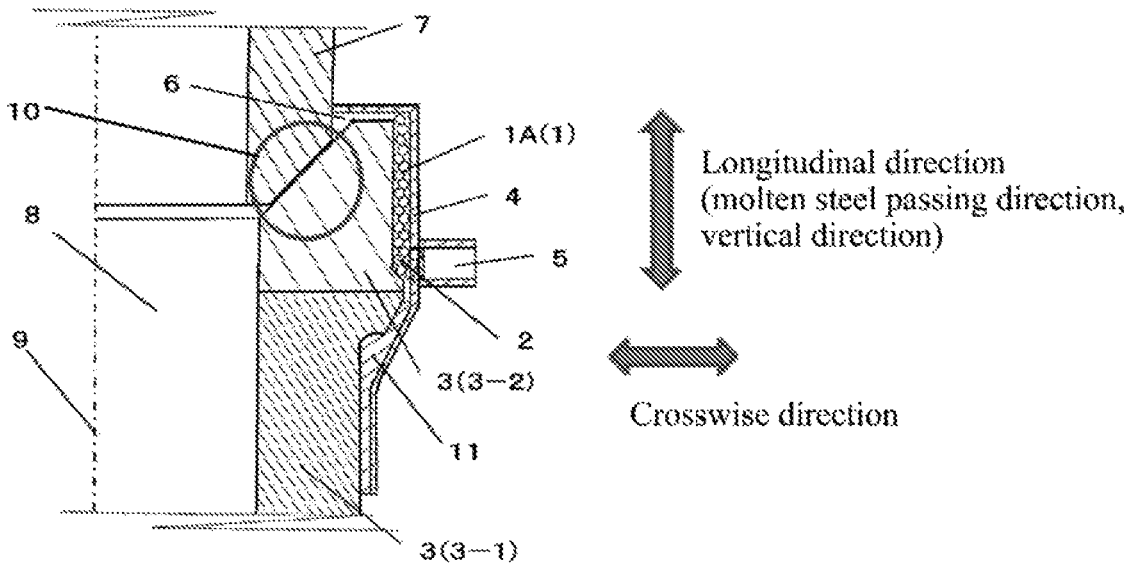
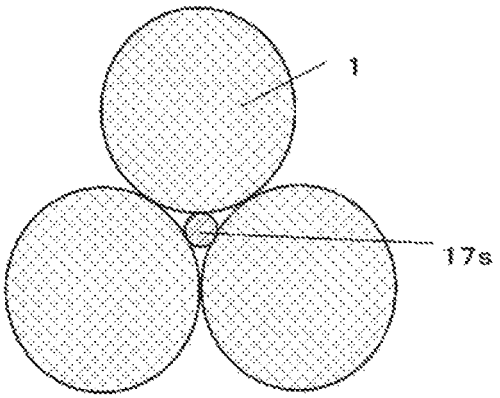
Fig. 13

Fig. 14
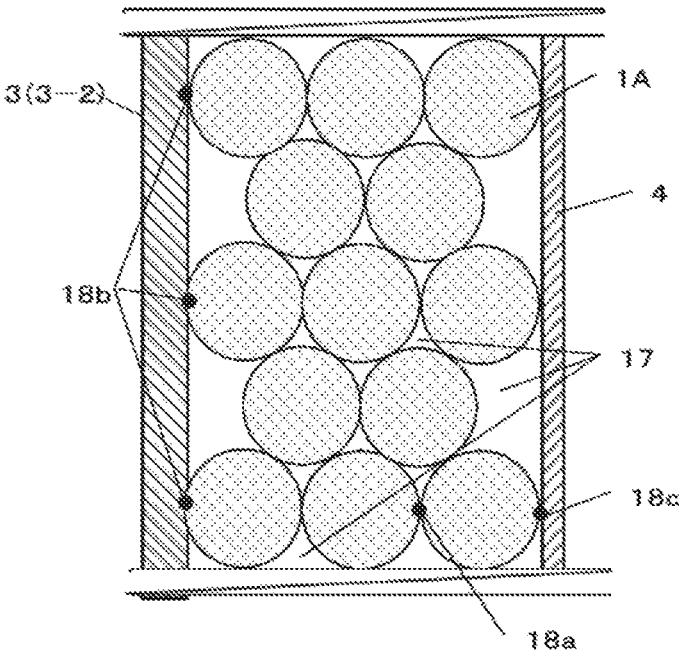
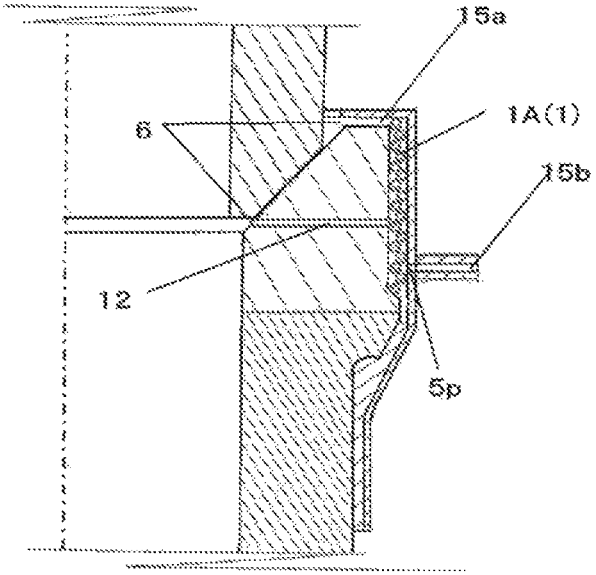
Fig. 15

CASTING NOZZLE

TECHNICAL FIELD

The present invention relates to a casting nozzle for use in continuous casting of molten steel.

BACKGROUND ART

In continuous casting of molten steel, as a means to discharge molten steel from a ladle to a tundish, a long nozzle as a casting nozzle is commonly used so as to suppress oxidation of molten steel, and entrainment of slag on an upper surface of molten steel within the tundish into the molten steel. On the other hand, as a means to pour molten steel from the tundish to a mold, an immersion nozzle as a casting nozzle is commonly joined beneath a lower nozzle attached to the bottom of the tundish.

The following description will be made by mainly taking the long nozzle as an example of a casting nozzle.

The long nozzle is joined to a lower nozzle installed to the bottom of the ladle through a packing (sealing) member or the like. Between the lower nozzle and the long nozzle, a high level of tight contact performance (sealing performance) is required to suppress (a) mixing of air (oxygen, etc.) in molten steel, (b) leakage of molten steel from a joint portion between the lower nozzle and the long nozzle, and (c) wear damage of the vicinity of the joint portion due to oxidation and the like when the lower nozzle and the long nozzle are made of a carbon-containing material, etc. Further, detaching and re-attaching of the long nozzle with respect to the lower nozzle are performed every time replacement of the ladle. That is, the detaching and re-attaching are repeated a number of times equal to that of the replacement of the ladle.

In the joint portion between the lower nozzle and the long nozzle, the tight contact performance is likely to be deteriorated due to the detaching and re-attaching work, adhesion of molten steel, slag, etc., damage to the nozzles, and others, resulting in formation of a gap. The formation of a gap leads to deterioration in sealing performance, which raises a risk that air is drawn inside the nozzles to cause oxidation of molten steel, damage to the nozzles due to oxidation when the nozzles are made of a carbon-containing refractory material, etc.

As one measure against this problem, a technique of blowing inert gas from the vicinity of an upper end of the long nozzle is employed. For example, the following Patent Documents 1 to 3 disclose a long nozzle which comprises a nozzle body made of a refractory material, and a metal casing disposed to surround an outer periphery of an upper end of the nozzle body, wherein the long nozzle is configured to blow out gas from a gap between the upper end of the nozzle body and the metal casing, or the like. In these Patent Documents, an air gap for gas flow (this air gap will hereinafter be referred to as "gas pool") is formed between an outer peripheral surface of the upper end of the nozzle body and an inner peripheral surface of the metal casing.

Further, for example, the following Patent Document 4 discloses a long nozzle which comprises a nozzle body made of a refractory material, and a metal casing disposed to surround an outer periphery of an upper end of the nozzle body, wherein the long nozzle is configured to blow out gas from an inner bore of the nozzle body at a position beneath a joint portion with a lower nozzle. In the Patent Document 4, a gas pool is formed between an outer peripheral surface of the upper end of the nozzle body and an inner peripheral surface of the metal casing.

CITATION LIST

Parent Document

Patent Document 1: JP 2011-212721A
Patent Document 2: JP 2014-133241A
Patent Document 3: JP H05-023808A
Patent Document 4: JP S62-130753A

SUMMARY OF INVENTION

Technical Problem

In the long nozzles as described in the above Patent Documents which are configured such that an air gap serving as the gas pool is formed between the outer peripheral surface of the upper end of the nozzle body and the inner peripheral surface of the metal casing, breaking such as cracking is likely to occur somewhere in the upper end of the nozzle body in a region where the air gap exists. The occurrence of such breaking causes unevenness of the blowout of gas, and raises a risk of drawing of outside air (oxygen) into the inner bore, or leakage of molten steel.

The immersion nozzle installed between the tundish and a mold has the same problem.

A problem to be solved by the present invention is to suppress or prevent such breaking of the nozzle body of the casting nozzle.

Solution to Technical Problem

The present invention provides a casting nozzle having features described in the following sections 1 to 10.

1. A casting nozzle comprising: a nozzle body; a metal casing disposed to surround an upper end of the nozzle body to form a gas pool between an outer peripheral surface of the upper end of the nozzle body and an inner peripheral surface of the metal casing; and a bridging segment provided in at least a part of the gas pool to bridge between the outer peripheral surface of the upper end of the nozzle body and the inner peripheral surface of the metal casing.

2. The casting nozzle described in the section 1, wherein the bridging segment is composed of a round iron bar, or a square iron bar, or a combination thereof.

3. The casting nozzle described in the section 2, wherein the bridging segment is disposed to extend in a longitudinal direction of the nozzle body, and welded to the metal casing partly or entirely along the longitudinal direction.

4. The casting nozzle described in the section 1, wherein the bridging segment is composed of heat-resistant particles.

5. The casting nozzle described in the section 4, wherein the heat-resistant particles are filled in at least a part of the gas pool in a state in which they are bonded neither to each other nor to any of the surfaces defining the gas pool.

6. The casting nozzle described in the section 4 or 5, wherein the heat-resistant particles have a particle size of 0.65 mm or more.

7. The casting nozzle described in any one of the sections 4 to 6, wherein the heat-resistant particles have an approximately spherical shape or an approximately prolate spheroidal shape.

8. The casting nozzle described in any one of the sections 4 to 7, wherein the heat-resistant particles are made of a material which is one or more selected from the group consisting of an inorganic material, an iron-based metal material and a copper-based metal material.

9. The casting nozzle described in the section 8, wherein the inorganic material is one or more selected from the group consisting of an alumina-based material, a silica-based material, a spinel-based material, a magnesia-based material, a zirconia or zircon-based material, a Ca-containing cement-based material, a carbon-based material, a carbide-based material, a sialon-based ceramic material and a glass-based material.

10. The casting nozzle described in the any one of the sections 4 to 9, wherein the gas pool has one or more of a gas inlet, a gas outlet, and a hole serving as a pathway communicating with the gas outlet (hereinafter referred to collectively as "gas port"), wherein a minimum size of the gas port in its cross-section perpendicular to a gas flow direction, taken at at least an inwardmost position to the gas pool, is less than a minimum particle size of the heat-resistant particles.

Effect of Invention

In the casting nozzle according to the present invention, the bridging segment is provided in at least a part of the gas pool to bridge between the outer peripheral surface of the upper end of the nozzle body and the inner peripheral surface of the metal casing. Thus, in the casting nozzle configured to form a gas pool between the outer peripheral surface of the upper end of the nozzle body and the inner peripheral surface of the metal casing, it is possible to suppress the occurrence of breaking of the upper end of the nozzle body. It is also possible to prevent or reduce oxidation of an inner bore of the casting nozzle and the vicinity of a joint portion with a lower nozzle, and erosion caused by iron oxide or the like, thereby preventing leakage of molten steel from the vicinity of the joint portion and deterioration in steel quality.

In one embodiment of the present invention where heat-resistant particles are filled in at least a part of the gas pool, the heat-resistant particles fulfill a function of dispersing stress, so that it is possible to suppress or prevent breaking of the upper end of the nozzle body.

In one embodiment of the present invention where the heat-resistant particles are bonded neither to each other nor to the nozzle body and the metal casing, even when deformation of the gas pool occurs, the heat-resistant particles themselves can be displaced to provide an effect of suppressing or preventing stress concentration.

In addition, it is only necessary to fill the heat-resistant particles in al least a part of the gas pool and restrain the filled part by a mechanical external force, e.g., by pressing. Thus, as compared with a case where a plurality of components are fixedly provided within the gas pool at respective positions, a production process becomes simpler and easier, so that it is possible to produce the casting nozzle within a shorter period of time at lower cost.

BRIEF DESCRIPTION OF DRAWINGS

FIG. 1 is a longitudinal sectional view of a long nozzle as one example of a casting nozzle according to a first embodiment of the present invention (this long nozzle has a structure in which a joint portion with a lower nozzle has a certain angle).

FIG. 2 is a conceptual diagram showing a force applied to the joint portion and a radial reaction force, in the example of FIG. 1.

FIG. 3 is a longitudinal sectional view of a long nozzle as another example of the casting nozzle according to the first embodiment (this long nozzle has a structure in which a joint portion with a lower nozzle has no angle).

FIG. 4 is a longitudinal sectional view showing one example of a conventional long nozzle, together with a lower nozzle joined thereto, wherein a ceramic sheet or a sealing material is provided in a joint portion between the lower nozzle and the long nozzle.

FIG. 5 is a conceptual diagram showing one example of the arrangement of a bridging segment in a casting nozzle according to the present invention, in a state in which an inner peripheral surface of a metal casing or an outer peripheral surface of a long nozzle body of the long nozzle is developed, wherein the bridging segment is composed of a plurality of columnar elements arranged to extend in a longitudinal direction of the long nozzle body in parallel relation, wherein a cross-sectional shape of each of the columnar elements is not particularly limited.

FIG. 6 is a conceptual diagram showing another example of the arrangement of the bridging segment in the casting nozzle according to the present invention, in the state in which the inner peripheral surface of the metal casing or the outer peripheral surface of the long nozzle body is developed, wherein the bridging segment is composed of a plurality of columnar elements arranged to extend obliquely in parallel relation.

FIGS. 11A to 11C are conceptual diagrams showing examples of the shape and arrangement of the bridging segment in the casting nozzle according to the present invention, in a section taken in a crosswise direction with respect to a space as a gas pool between the outer peripheral surface of the long nozzle body and the inner peripheral surface of the metal casing, wherein FIGS. 11A, 11B, and 11C are, respectively, FIG. 11A an example in which a round bar, i.e., a column, is disposed such that a length direction thereof is oriented in the longitudinal direction, FIG. 11B an example in which a square bar, i.e., a quadrangular prism, is disposed such that a length direction thereof is oriented in the longitudinal direction, and FIG. 11C an example in which a column or quadrangular prism is disposed such that a length direction thereof is oriented in the circumferential direction, along respective curvatures of the inner and outer peripheral surfaces (gas pool-defining surfaces).

FIG. 12 is a longitudinal sectional view of a long nozzle as one example of a casting nozzle according to a second embodiment of the present invention (this long nozzle has a structure in which a joint portion with a lower nozzle has a certain angle).

FIG. 13 is a conceptual diagram showing a space among adjacent three spherical heat-resistant particles, conceptually expressed as an inscribed circle, in a state in which the heat-resistant particles are filled in a gas pool in the casting nozzle according to the present invention.

FIG. 14 is a conceptual diagram showing one example of the state in which the spherical heat-resistant particles are filled in the gas pool in the casting nozzle according to the present invention.

FIG. 15 is a conceptual diagram showing examples of the arrangement and relative sizes of a gas inlet, a gas outlet and a hole serving as a pathway communicating with the gas outlet (gas port) of a gas pool at least partially filled with heat-resistant particles in a long nozzle as one example of the casting nozzle according to the present invention.

DESCRIPTION OF EMBODIMENTS

Figure 7:
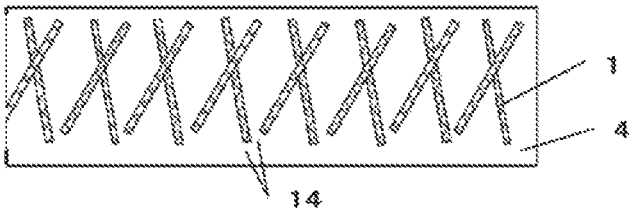
FIG. 7 is a conceptual diagram showing yet another example of the arrangement of the bridging segment in the casting nozzle according to the present invention, in the state in which the inner peripheral surface of the metal casing or the outer peripheral surface of the long nozzle body is developed, wherein the bridging segment is composed of a plurality of columnar elements arranged such that adjacent two of them extend obliquely in crossing relation.
Figure 8:
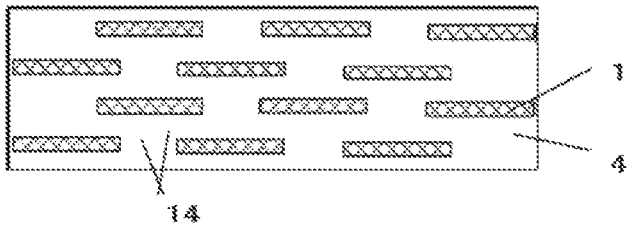
FIG. 8 is a conceptual diagram showing still another example of the arrangement of the bridging segment in the casting nozzle according to the present invention, in the state in which the inner peripheral surface of the metal casing or the outer peripheral surface of the long nozzle body is developed, wherein the bridging segment is composed of a plurality of parallel lines extending in a circumferential direction of the long nozzle body and each consisting of two or more columnar elements arranged such that a length direction of each of them is arranged in the circumferential direction, and wherein the columnar elements in the parallel lines are arranged in a staggered pattern when viewed in the longitudinal direction.
Figure 9:
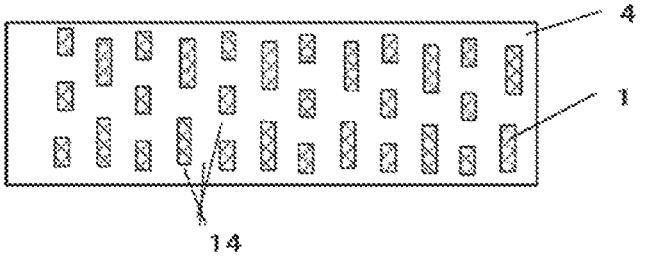
FIG. 9 is a conceptual diagram showing yet still another example of the arrangement of the bridging segment in the casting nozzle according to the present invention, in the state in which the inner peripheral surface of the metal casing or the outer peripheral surface of the long nozzle body is developed, wherein the bridging segment is composed of a plurality of columnar elements arranged to extend in the longitudinal direction in parallel relation, and wherein each of the columnar elements is divided into two or more sub-elements which are arranged in a dispersed manner.
Figure 10:
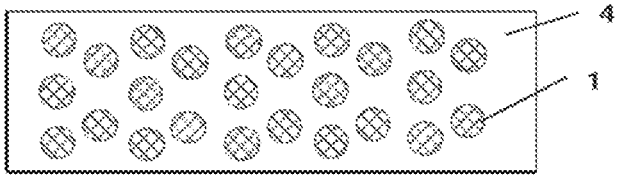
FIG. 10 is a conceptual diagram showing another further example of the arrangement of the bridging segment in the casting nozzle according to the present invention, in the state in which the inner peripheral surface of the metal casing or the outer peripheral surface of the long nozzle body is developed, wherein the bridging segment is composed of a plurality of columnar elements arranged in a dispersed manner, such that opposite circular end faces of each of them face, respectively, the outer peripheral surface of the long nozzle body and the inner peripheral surface of the metal casing.

Embodiments of the present invention and practical examples thereof will now be described by taking a long nozzle as one example of a casting nozzle, while appropriately referring to the drawings.

First Embodiment

Describing by referring to a conventional long nozzle as shown in FIG. 4, breaking such as cracking of a long nozzle body (in this specification, also referred to simply as "nozzle body") 3 of the long nozzle in which a gas pool 2 is formed between an outer peripheral surface of the long nozzle body 3 and an inner peripheral surface of a metal casing 4 occurs due to a phenomenon that a force is applied to a joint portion with a lower nozzle 7 in a direction from a central axis of the long nozzle extending in a molten steel passing direction (which corresponds to a vertical direction when used; hereinafter referred to simply as "longitudinal direction") toward an outer periphery of the long nozzle, i.e., in a radial direction (hereinafter also referred to simply as "crosswise direction").

This radial force primarily arises by the action of either one or a combination of two events: (1) press-contact in a joint portion between the lower nozzle and the long nozzle, and (2) partial contact or local compression in the joint portion between the lower nozzle and the long nozzle.

With regard to (1) press-contact in the joint portion between the lower nozzle and the long nozzle, in a case where the joint portion between the lower nozzle and the long nozzle has an angle inclined obliquely upwardly with respect to the crosswise direction, as in a joint portion 10 shown in FIG. 1, i.e., the joint portion has an angle less than 90° with respect to the longitudinal direction, a vertically-acting press-contact force during joining generates a radial vector, as shown in FIG. 2, and thereby the long nozzle body is pulled in its circumferential direction, resulting in the occurrence of primarily longitudinal cracking or breaking.

With regard to (2) partial contact or local compression in the joint portion between the lower nozzle and the long nozzle, for example, in a case where the lower nozzle and the long nozzle are joined in a state in which their central axes are offset from each other, they are only partially brought into contact with each other in the circumferential direction, so that a radial force is locally applied to the partial contact portion, and thereby a tension force acts on the long nozzle body in the longitudinal direction or a bending force acts on the vicinity of the joint portion in the crosswise direction, resulting in the occurrence of cracking or breaking (Refer to an arrowed line in FIG. 3 indicating a direction of offset of the central axis of the lower nozzle with respect to the central axis of the long nozzle).

As shown in FIG. 4, in the conventional structure, the gas pool 2 is a simple space in which there is no element for restraining the long nozzle body. Thus, if the above event (1) or (2) arises in such a conventional structure, the long nozzle body will break.

Therefore, a long nozzle according to the present invention comprises a bridging segment 1 provided in at least a part of a gas pool 2 to bridge between an outer peripheral surface of of a nozzle body 3 and an inner peripheral surface of a metal casing 4, as exemplified in FIG. 1. This bridging segment 1 functions to restrain the outer peripheral surface of the nozzle body 3 in its radial direction, so that, when a force is applied to the long nozzle body due to the above event (1) or (2), the long nozzle body is restrained such that deformation and displacement thereof toward the gas pool 2 are less likely to occur, thereby preventing or suppressing the occurrence of cracking or breaking in the long nozzle body 3.

Therefore, in the long nozzle according to the present invention, the bridging segment is preferably provided in a part or entirety of a region of the gas spool which corresponds to at least a joint portion with a lower nozzle, i.e., which is a projection of the joint portion with the lower nozzle toward the outer peripheral surface of the long nozzle body.

For example, in a case where a force is applied only to a specific portion or only in a specific direction such as a sliding direction of a sliding nozzle plate provided just above the lower nozzle, or a specific movement direction of a long nozzle attaching device, and cracking or breaking occurs in a region of the long nozzle body falling within the specific portion or facing the specific direction, the bridging segment may be provided only in a region of the gas pool which corresponds to the region of the long nozzle body falling within the specific portion or facing the specific direction.

Preferably, in a case where a force is applied to the long nozzle body over the entire range in a circumferential direction thereof, three or more bridging segments are provided circumferentially at even intervals. It is preferable to provide the bridging segment as many as possible or as broad as possible.

Here, considering that the gas pool is a space intended to supply inert gas to a gas outlet (e.g., an area designated by the reference sign 6 in FIG. 1) therethrough, the bridging segment needs to be provided with a space or a discontinuous region serving as a part of a required gas flow pathway so as not to hinder flow of the inert gas. However, in a part of the gas pool having no need for a gas flowing function, e.g., in a case where the gas flow pathway may exist only in a longitudinally-upward region of the gas pool, and no gas flow is required in a longitudinally-downward region of the gas pool, the bridging segment may be formed in a structure continuous over the entire range in the circumferential direction.

Figure 11A:
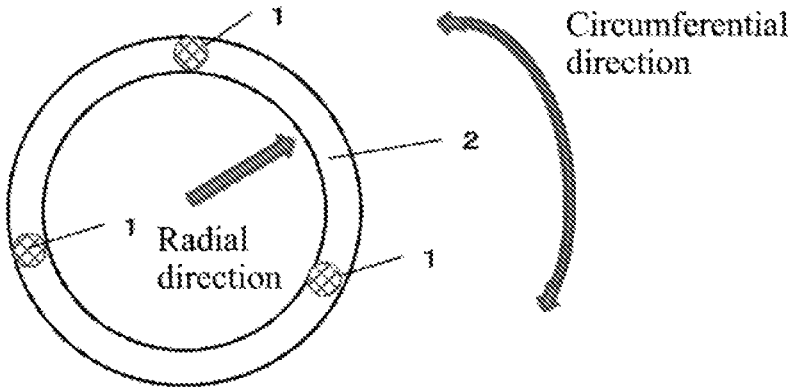
Figure 11B:
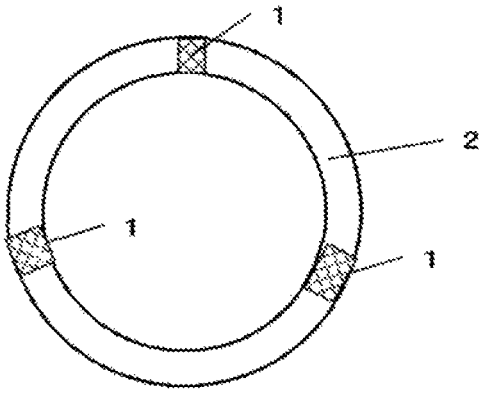
Figure 11C:
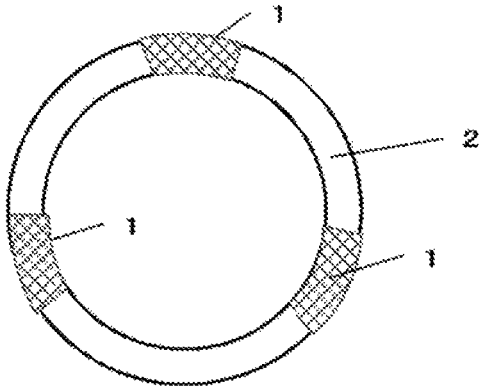

A contact portion or joint portion between the bridging segment and each of the outer peripheral surface of the long nozzle body and the inner peripheral surface of the metal casing, may have a dot shape, a line shape or a plane shape, as long as it is possible to obtain a function of restraining a relative position of the outer peripheral surface of the long nozzle body and the inner peripheral surface of the metal casing. However, from a viewpoint of enhancing a stress dispersion effect to minimize the occurrence of breaking of the long nozzle body, the contact portion or joint portion is preferably provided as broad as possible, so that a line shape is more preferable than a dot shape, and a plane shape is more preferable than a line shape (Refer to FIGS. 11A to 11C).

In the case where the contact portion or joint portion has a plane shape, it may be any one of various shapes such as a circular shape, an elliptical shape, a polygonal shape and a sector shape, and the bridging segment may have a columnar shape or a conical or pyramid shape.

The gas pool is formed to extend in the circumferential direction of the long nozzle body, so that each of opposite surfaces of the bridging segment in contact, respectively, with the outer peripheral surface of the long nozzle body and the inner peripheral surface of the metal casing is formed in a curved surface conforming to a curvature of a corresponding one of the outer and inner peripheral surfaces.

The bridging segment may be a refractory material similar or identical to that of the long nozzle body, or may be a material different from that of the long nozzle body, such as a gas-permeable refractory material or a metal material. During casting operation, a region around the gas pool typically has a temperature of about 1200° C. or less (between about 1200° C. and several hundred ° C.), because there is a cooling effect by gas flowing through the gas pool. Thus, the bridging segment may be made a material capable of existing in such a temperature range during casting operation. Specific examples of a refractory material therefor may include: a refractory material commonly used in casting components, such as an alumina-based refractory material, an alumina-silica based refractory material, or an alumina-graphite based refractory material; and a low refractory material such as a chamotte-based refractory material or a glassy refractory material. Further, it is possible to use a metal material for use in, e.g., the metal casing or the like, such as common steel, and a round iron bar, a square iron bar or the like for use in a commercially available building material and others.

The bridging segment may be in a contact state or in a joined or fixed state, with respect to the outer peripheral surface of the long nozzle body or the inner peripheral surface of the metal casing. However, from a viewpoint of maintaining an installation position of the bridging segment, it is preferable that the bridging segment is fixed to one of the outer peripheral surface of the long nozzle body and the inner peripheral surface of the metal casing. That is, the bridging segment may be configured as a structure integral with the long nozzle body or the metal casing, or may be configured to be installed as a component separate from the long nozzle body or the metal casing. The structure integral with the long nozzle body or the metal casing includes a raised portion protruding from the long nozzle body or the metal casing. The raised portion protruding from the metal casing can be formed by subjecting the metal casing to pressing or drawing.

In the case where the bridging segment is composed of a round iron bar, a square iron bar or the like, the iron bar or the like may be partly or entirely welded and fixed to the metal casing. In a technique of welding such a bar-shaped member while placing the bar-shaped member such that a length direction thereof is oriented in the longitudinal direction, a widely-distributed raw material can be used, and there is no need to form a curved surface conforming to the circumference of the inner or outer peripheral surface, so that it is possible to easily produce the bridging segment at relatively low cost. That is, from a viewpoint of cost and easiness in terms of the production, the bridging segment is preferably composed of a round iron bar, a square iron bar or a combination thereof. Further, more preferably, the bridging segment is disposed to extend in the longitudinal direction, and welded to the metal casing partly or entirely along the longitudinal direction. Here, the state "the bridging segment is disposed to extend in the longitudinal direction" includes a state in which, when the gas pool is formed in a taper shape, the bridging segment has a surface inclined with respect to the radial direction and a surface which is not inclined with respect to the circumferential direction.

Practical Examples of First Embodiment

Practical Example A

A practical example A is an example in which, in the structure shown in FIG. 1, the bridging segment is composed of eight round iron bars, wherein the round iron bars are arranged at respective positions on the circumference of the inner peripheral surface of the metal casing and weldingly joined to the metal casing in a state in which each of them extends in a direction parallel to the longitudinal direction of the long nozzle body (i.e., in the longitudinal direction).

In actual casting operation using a conventional structure devoid of the bridging segment (i.e., a comparative example (structure obtained by removing the bridging segment 1 from the structure (practical example A) in FIG. 1), longitudinal cracking or braking due to splitting caused by the cracking occurred in the long nozzle body. On the other hand, in actual casting operation using the long nozzle of the practical example A according to the first embodiment, the occurrence of breaking including cracking was completely prevented.

In another structure having a higher effect of restraint or stress dispersion in the crosswise direction, such as a structure in which gas cannot flow through a discontinuous region 14 straight in the longitudinal direction, or a discontinuous region 14 extending in the longitudinal direction is relatively narrow, or a structure comprising elements extending in the crosswise direction, as shown in, e.g., FIGS. 6 to 8 and 10, the effect of suppressing or preventing breaking such as cracking is considered to be higher than that of the structure of the practical example A.

However, in the structure of the practical example A in which the bridging segment and the outer peripheral surface of the long nozzle body are in contact with each other linearly in the longitudinal direction, and gas can flow through the discontinuous region 14 straight in the longitudinal direction, cracking is considered to be more likely to occur in the long nozzle body in the longitudinal direction, as compared to the aforementioned structure which is further enhanced in terms of the effect of suppressing or preventing breaking such as cracking. However, the practical example A also could perfectly obtain the effect of suppressing or preventing breaking such as cracking.

Thus, the aforementioned structure which is further enhanced in terms of the breaking suppressing or preventing effect may be appropriately selected depending on an individual condition relating to the cause of breaking such as cracking, e.g., the level of force to be applied to the long nozzle body during actual casting operation, specifically, for example, when a press-contact force between the long nozzle and the lower nozzle is relatively large.

Second Embodiment

In a second embodiment of the present invention, heat-resistant particles 1A are filled in at least a part (a part or substantially the entire region of) the gas pool 2, as exemplified in FIG. 12, and the bridging segment 1 is composed of the filled heat-resistant particles 1A. Then, this bridging segment 1 functions to restrain the outer peripheral surface of the nozzle body 3 in the radial direction as mentioned above, and the heat-resistant particles 1A composing the bridging segment 1 brings out a stress dispersion effect.

In the second embodiment, preferably, the heat-resistant particles 1A are filled (restrained) within the gas pool (in substantially the entire region of the gas pool) in a state in which they are bonded (joined) neither to each other nor to any of the surfaces defining the gas pool (gas pool-defining surfaces), although some of them are in contact with the surfaces. That is, preferably, the heat-resistant particles 1A are restrained mutually and between the gas pool-defining surfaces, but are relatively displaceable. Thus, the heat-resistant particles 1A themselves displaceably move in response to a change in stress which is mainly an external force generated from the side of an inner bore of the long nozzle body, so that it is possible to always and automatically disperse the stress evenly over the entire region of the gas pool filled with the heat-resistant particles, thereby preventing breaking of the nozzle body due to stress concentration. Further, even when deformation of the gas pool occurs due to deformation of the metal casing or the like during or after heat receiving or the like, the heat-resistant particles can move within the gas pool in conformity to the shape of the gas pool, so that it is possible to more easily maintain the function of dispersing stress over the entire region of the gas pool.

Preferably, in order to realize such even stress dispersion, in an operation of charging the heat-resistant particles, the heat-resistant particles are charged to be compressed so as to be restrained within the gas pool to the extent that they are prevented from flowing naturally (unless an external force is applied thereto). Specifically, the heat-resistant particles may be filled in the gas pool in a dried state without using an adhesive or the like, and restrained by setting a plug or the like so as not to flow naturally. On the other hand, for example, in a case where the relative position of the gas pool-defining surfaces is fixed by a component having a given size, it is necessary to install the component while adjusting the size thereof in conformity to shape accuracy of the gas pool-defining surfaces. Differently, in the second embodiment, such an adjustment is not required, so that it is possible to easily produce the bridging segment at lower cost within a shorter period of time.

It should be noted that, even when the heat-resistant particles are bonded to each other, or to one of the gas pool-defining surfaces, the stress dispersion effect can be fairly obtained by filling of the heat-resistant particles so as to suppress or prevent breaking of the nozzle body. Further, even when the heat-resistant particles are filled only in a part of the gas pool, the stress dispersion effect can be obtained at least in the partial region, so that it is possible to suppress or prevent breaking of the nozzle body.

The gas pool itself serves as a gas flow passage, and has a pressure accumulation or pressure equalization function. From this point of view, spaces for allowing gas to flow therethrough are formed between respective ones of the heat-resistant particles and between the heat-resistant particles and the gas pool-defining surfaces.

Considering, e.g., the fact that a commonly-used gas-permeable porous refractory material has a maximum pore size of about 50 μm or more and an average pore size of around 100 μm, a space for allowing gas to smoothly flow therethrough can also be deemed to be ensured among adjacent three of the heat-resistant particles by setting a maximum space size and an average space size of the space, respectively, to about 50 μm or more and about 100 μm or more. When the pore diameter (space diameter) is calculated based on a geometrically simplified model on the assumption that the shape of the heat-resistant particle is sphere, the diameter of an inscribed circle 17*s* (see FIG. 13) of a space surrounded by three spheres is about 0.155 times the diameter Ds of the sphere. Assuming that the diameter of the inscribed circle 17*s* is 100 μm, the particle size (diameter when the heat-resistant particle has a spherical shape) of the heat-resistant particle is preferably about 0.65 mm or more.

In fact, there are spaces around the inscribed circle 17*s*, and a space between each of the gas pool-defining surfaces and some of the heat-resistant particles is greater than the space among the adjacent three heat-resistant particles. Thus, an actual space is greater than that described above. Here, the state "the particle size of the heat-resistant particle is 0.65 mm or more" means that the heat-resistant particle has a size capable of being left on a virtual sieve having an opening size of 0.65 mm.

From a viewpoint of increasing gas passability (gas permeability), it is preferable that heat-resistant particles having an approximately maximum allowable size for filling are filled in the gas pool.

Further, in order to ensure a sufficient space 17 among the heat-resistant particles (see FIG. 14), the surface shape of the heat-resistant particle is preferably a curved surface, more preferably an approximately spherical shape or an approximately prolate spheroidal shape, most preferably a spherical shape.

On the other hand, when the size of the heat-resistant particle is set to an approximately maximum value Tillable in the gas pool in order to maximize the size of the space among the heat-resistant particles from the viewpoint of gas passability, the number of contact points of the heat-resistant particles with the gas pool-defining surfaces (the reference signs 18*b* and 18*c* in FIG. 14) decreases, and thereby the stress dispersion effect is deteriorated.

Thus, the size of the heat-resistant particle is preferably determined based on a balance between the stress dispersion effect and the gas passability, depending on casting conditions such as a gas pressure in the gas pool, the size of the gas pool, the length of the gas flow passage, the area of the gas outlet, and a discharge rate of gas.

A decrease of the size of the heat-resistant particle is disadvantageous from the viewpoint of the gas passability. However, it is advantageous from a viewpoint of equalizing the gas discharge rates from a plurality of openings of the gas outlet, because as the size of the heat-resistant particle becomes smaller, the internal pressure of the gas pool becomes higher. Thus, the size of the heat-resistant particle is preferably determined while also taking into account the equalization of the gas discharge rates.

As shown in, e.g., FIG. 15, the gas pool is provided with one or more of a gas inlet 5*p*, a gas outlet 6, and a hole 12 serving as a pathway communicating with the gas outlet (these will hereinafter be referred to collectively as "gas port"). Here, in order to prevent the heat-resistant particles from flowing out from this gas port, a minimum size of the gas port in its cross-section perpendicular to a gas flow direction, taken at at least an inwardmost position to the gas pool, is less than a minimum particle size of the heat-resistant particles.

Figure 16:
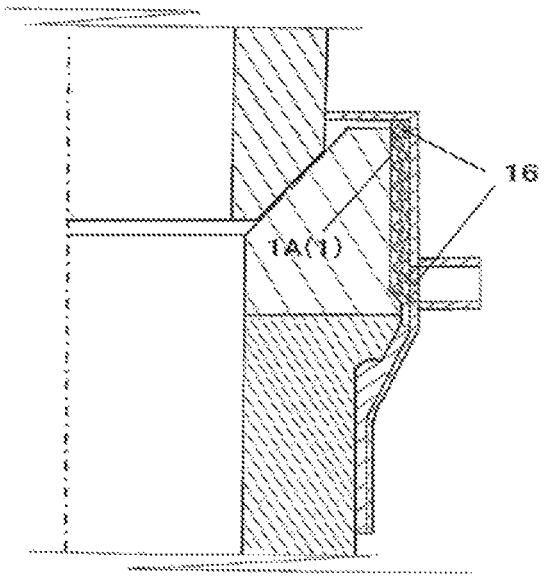
FIG. 16 is a conceptual diagram showing an example in which a filter or the like is installed in the long nozzle as one example of the casting nozzle according to the present invention to prevent the heat-resistant particles filled in at least a part of the gas pool from flowing out from the gas inlet or the like of the gas pool.

Further, as shown in, e.g., FIG. 16, a filter 16 or the like may be provided in the gas port to prevent flow-out of the heat-resistant particles. In this case, although the minimum size of the gas port in its cross-section perpendicular to the gas flow direction, taken at at least the inwardmost position to the gas pool, may be equal to or greater than the minimum particle size of the heat-resistant particles, the opening size of this filter is preferably less than the minimum particle size of the heat-resistant particles.

Here, the term "heat-resistant" means a property which is free of the occurrence of softening, melting, disappearance or the like when it is exposed to a maximum temperature of the gas pool. Specifically, it means a property capable of enduring the temperature of the gas pool which can vary according to various conditions such as casting conditions, the structure and arrangement of the gas pool, and the cooling effect by gas (flow rate, etc.).

In widely-used long nozzles or immersion nozzles, the temperature of the gas pool during das discharge is about 800° C. or less, or, at the highest, about 1200° C. or less.

In the present invention, the heart-resistant particles may be made of a material which is one or more selected from the group consisting of an inorganic material, an iron-based metal material, a copper-based metal material, and alloys thereof.

Examples of the inorganic material may include an alumina-based material, a silica-based material, a spinel-based material, a magnesia-based material, a zirconia or zircon-based material, a Ca-containing cement-based material, a carbon-based material, a carbide-based material, a sialon-based ceramic material and a glass-based material. Inert gas is supplied to flow through the gas pool, and thereby the heat-resistant particles are less likely to be oxidized or not oxidized. Thus, an oxidizable material such as a carbon-based material may be used.

That is, it is possible to use any material which is commonly used as a raw material of refractory products such as s molten metal processing furnace, a container, an atmosphere furnace and a nozzle.

As the above metal material or alloy, it is possible to use a metal material or alloy having a melting point (e.g., about 800° C. or more) exceeding a maximum temperature under individual casting conditions. Specifically, it is most preferable to use an iron-based material which is relatively low in terms of cost, and relatively high in terms of melting point.

LIST OF REFERENCE SIGNS

1: bridging segment
1A: heat-resistant particles
2: gas pool
3: long nozzle body (nozzle body)
3-1: long nozzle body (part thereof other than joint portion)
3-2: part of long nozzle body (part thereof around joint portion)
4: metal casing
5: gas inlet
6: gas outlet
7: lower nozzle
8: inner bore
9: central axis
10: joint portion between lower nozzle and long nozzle
11: filler
12: hole serving as pathway communicating gas outlet
13: ceramic sheet or sealing material
14: discontinuous region
15*a*: gap between upper end surface of nozzle body and portion of metal casing located just above upper end surface of nozzle body
15*b*: gas introduction nozzle
16: filter for preventing flow-out of heat-resistant particles (metal mesh or metal component with through holes or slits)
17: space (gas flow pathway)
17*s*: inscribed circle in space among adjacent three of heat-resistant particles
18*a*: contact point between heat-resistant particles
18*b*: contact point between heat-resistant particle and one of two gas pool-defining surfaces (outer peripheral surface of upper end of nozzle body)
18*c*: contact point between heat-resistant particle and the other gas pool-defining surface (inner peripheral surface of metal casing)

The invention claimed is:

1. A casting nozzle comprising:
a nozzle body;
a metal casing disposed to surround an upper end of the nozzle body to form a gas pool between an outer peripheral surface of the upper end of the nozzle body and an inner peripheral surface of the metal casing; and
a bridging segment provided in at least a part of the gas pool to bridge between the outer peripheral surface of the upper end of the nozzle body and the inner peripheral surface of the metal casing,
wherein the bridging segment is composed of a round iron bar, or a square iron bar, or a combination thereof.

2. The casting nozzle as claimed in claim 1, wherein the bridging segment is disposed to extend in a longitudinal direction of the nozzle body, and welded to the metal casing partly or entirely along the longitudinal direction.

3. A casting nozzle comprising:
a nozzle body;

a metal casing disposed to surround an upper end of the nozzle body to form a gas pool between an outer peripheral surface of the upper end of the nozzle body and an inner peripheral surface of the metal casing; and a bridging segment provided in at least a part of the gas pool to bridge between the outer peripheral surface of the upper end of the nozzle body and the inner peripheral surface of the metal casing, wherein the bridging segment is composed of heat-resistant particles, and the heat-resistant particles are filled in at least a part of the gas pool in a state in which they are bonded neither to each other nor to any of the surfaces defining the gas pool.

4. The casting nozzle as claimed in claim 3, wherein the heat-resistant particles have a particle size of 0.65 mm or more.

5. The casting nozzle as claimed in claim 3, wherein the heat-resistant particles have an approximately spherical shape or an approximately prolate spheroidal shape.

6. The casting nozzle as claimed in claim 3, wherein the heat-resistant particles are made of a material which is one or more selected from the group consisting of an inorganic material, an iron-based metal material and a copper-based metal material.

7. The casting nozzle as claimed in claim 6, wherein the inorganic material is one or more selected from the group consisting of an alumina-based material, a silica-based material, a spinel-based material, a magnesia-based material, a zirconia or zircon-based material, a Ca-containing cement-based material, a carbon-based material, a carbide-based material, a sialon-based ceramic material and a glass-based material.

8. The casting nozzle as claimed in claim 3, wherein the gas pool has one or more of a gas inlet, a gas outlet, and a hole serving as a pathway communicating with the gas outlet (hereinafter referred to collectively as "gas port"), and a minimum size of the gas port in its cross-section perpendicular to a gas flow direction, taken at least an inwardmost position to the gas pool, is less than a minimum particle size of the heat-resistant particles.

* * * * *